United States Patent [19]

Traister et al.

[11] 3,936,658

[45] Feb. 3, 1976

[54] FUSER APPARATUS FOR ELECTROSTATIC REPRODUCING MACHINES

[75] Inventors: Robert L. Traister, Fairport; Edward G. Reehil, Henrietta, both of N.Y.

[73] Assignee: Xerox Corporation, Stamford, Conn.

[22] Filed: Feb. 22, 1974

[21] Appl. No.: 445,012

[52] U.S. Cl. ..... 219/216; 219/471

[51] Int. Cl.[2] ..... H05B 1/00

[58] Field of Search ..... 219/216, 388, 469–471; 432/60, 228; 100/93 RP; 355/3, 14

[56] References Cited

UNITED STATES PATENTS 3,754,819 8/1973 Braun ..... 219/216

*Primary Examiner*—C. L. Albritton

[57] ABSTRACT

In an electrostatic reproducing machine an improved fusing apparatus is provided for fusing xerographic images onto copy sheets. The fusing apparatus comprises various actuable means including a pressure roller, a fuser roller, means for engaging and disengaging the pressure roller against the fuser roller, means for cooling end portions of the pressure roller, means for lubricating the fuser roller, and control means for actuating the various actuable means in a timed order and sequence to effect the fusing operation.

4 Claims, 3 Drawing Figures

FUSER APPARATUS FOR ELECTROSTATIC REPRODUCING MACHINES

This invention relates to an electrostatic reproducing machine and, more particularly, an improved fusing apparatus for use in such machines.

In the practice of xerography pioneered by Chester F. Carlson, as applied to the xerographic reproduction machines, typically a latent electrostatic image is formed on a photo-conductive medium, such as selenium drum or belt, and the latent image is then developed by toner particles and transferred to a copy sheet.

The transferred image is then fused onto the copy sheet for permanent retention. The fusing operation requires certain control and precaution; for example, the toner particles must be heated so that they fuse onto the sheet. Care must be exercised to assure that the fusing means is not over heated to cause fire hazard, or scorch or burn the copy sheet. Yet it must be heated to a temperature high enough to effect fusing operation.

With an ever increasing demand for high speed reproducing machines of the aforementioned type, serious efforts have been made to increase the throughput capacity of the machines so that more copies may be made safely, reliably and efficiently with least amount operator intervention in the running of the machines.

With the high speed machines designed for high throughput capacity, it has been found necessary to provide more precisely controlled and improved fusing apparatus so that the machine can effect its high built in throughput capacity and can, at the same time, operate efficiently and reliably.

It is therefore an object of the present invention to provide an improved fusing arrangement in an electrostatographic reproducing machine.

These and other objects of the present invention are obtained in accordance with the applicants' invention, by providing a fusing apparatus that includes a fuser roller and a pressure roller, and means for engaging the pressure roller into contact with the fuser roller when the machine is in operation and for disengaging the pressure roller from the fuser roller when the machine is not in operation and thus not making copies, or when the machine is in the standby mode.

It is another feature of the present invention to provide means for cooling the edge portions of the pressure roller when the copy sheets or the images to be fused are narrower than the fuser.

It is another feature of the present invention to provide control means for turning on the power applied to the heating means for the fuser roller when the machie power is turned on and turning it off when the machine is turned off or put into an interrupt condition.

The foregoing and other objects and features of the present invention will become clearer from the following detailed description of an illustrative embodiment of the present invention in conjunction with the accompanying drawings, in which.

DETAILED DESCRIPTION

Figure 1:
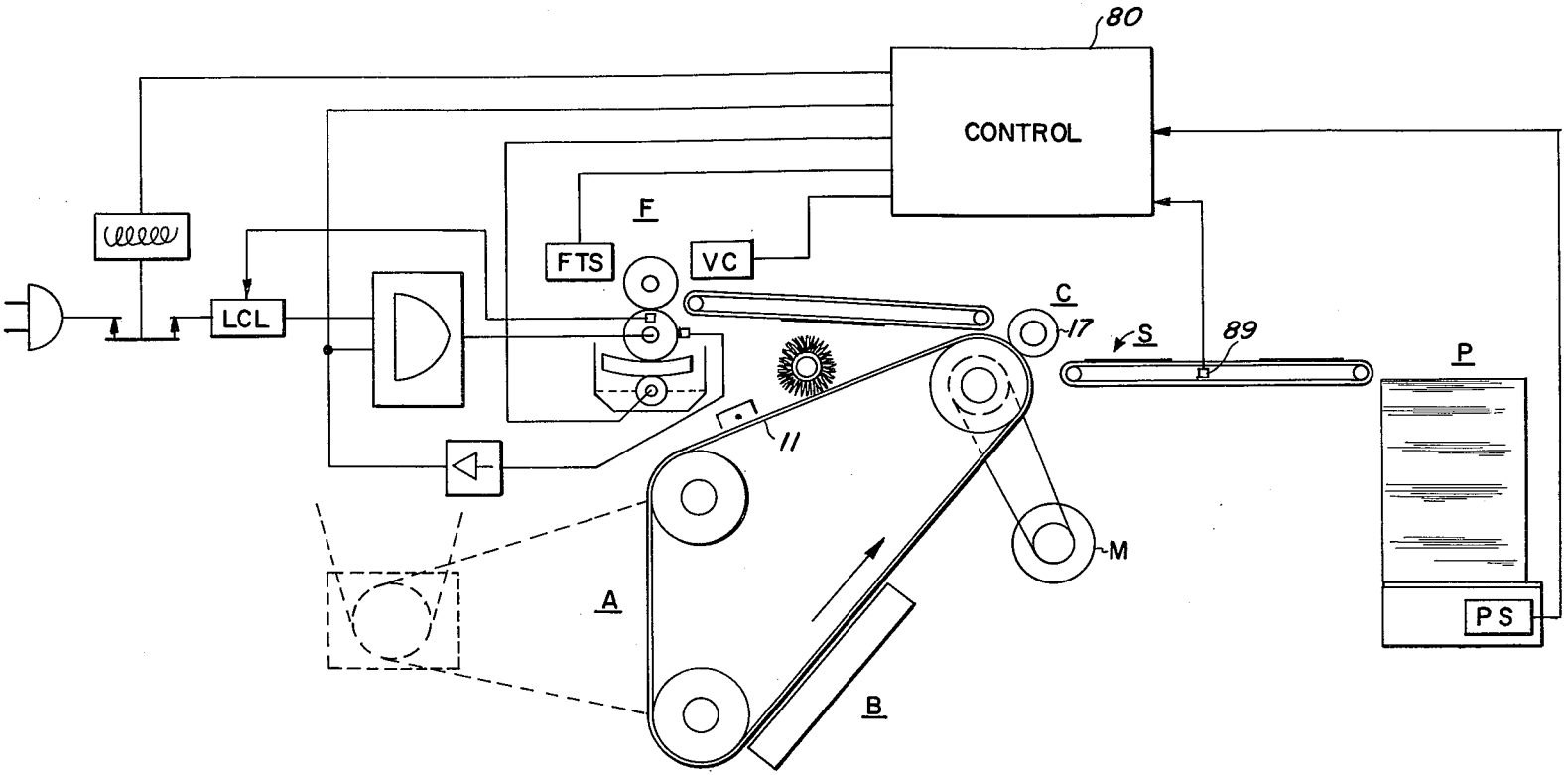
FIG. 1 shows schematically, an electrostatic reproducing machine in which the fuser apparatus of the present invention may be utilized.

For a general understanding of a high speed electrostatic reproducing machine in which the present invention may be incorporated, reference is made to FIG. 1. FIG. 1 shows only those machine components which are necessary to illustrate the environment in which the present apparatus may be utilized. As in all electrostatic reproducing systems, such as a xerographic machine of the type shown, an optical image of a document to be reproduced is projected onto a charged surface of a moving xerographic belt 11 to form an electrostatic latent image thereon at the imaging station A. Thereafter, the latent image is developed by toner particles at a developing station B using suitable means such as a magnetic brush developing means, and the developed image is then transferred, at a transfer station C, to a copy sheet S, fed from a paper supply tray P. The image transferred to the copy sheet S is then transported to a fusing station F where the image is fused. The copy sheet which now has the fused image thereon is transported to a suitable collection means (not shown).

Figure 2:
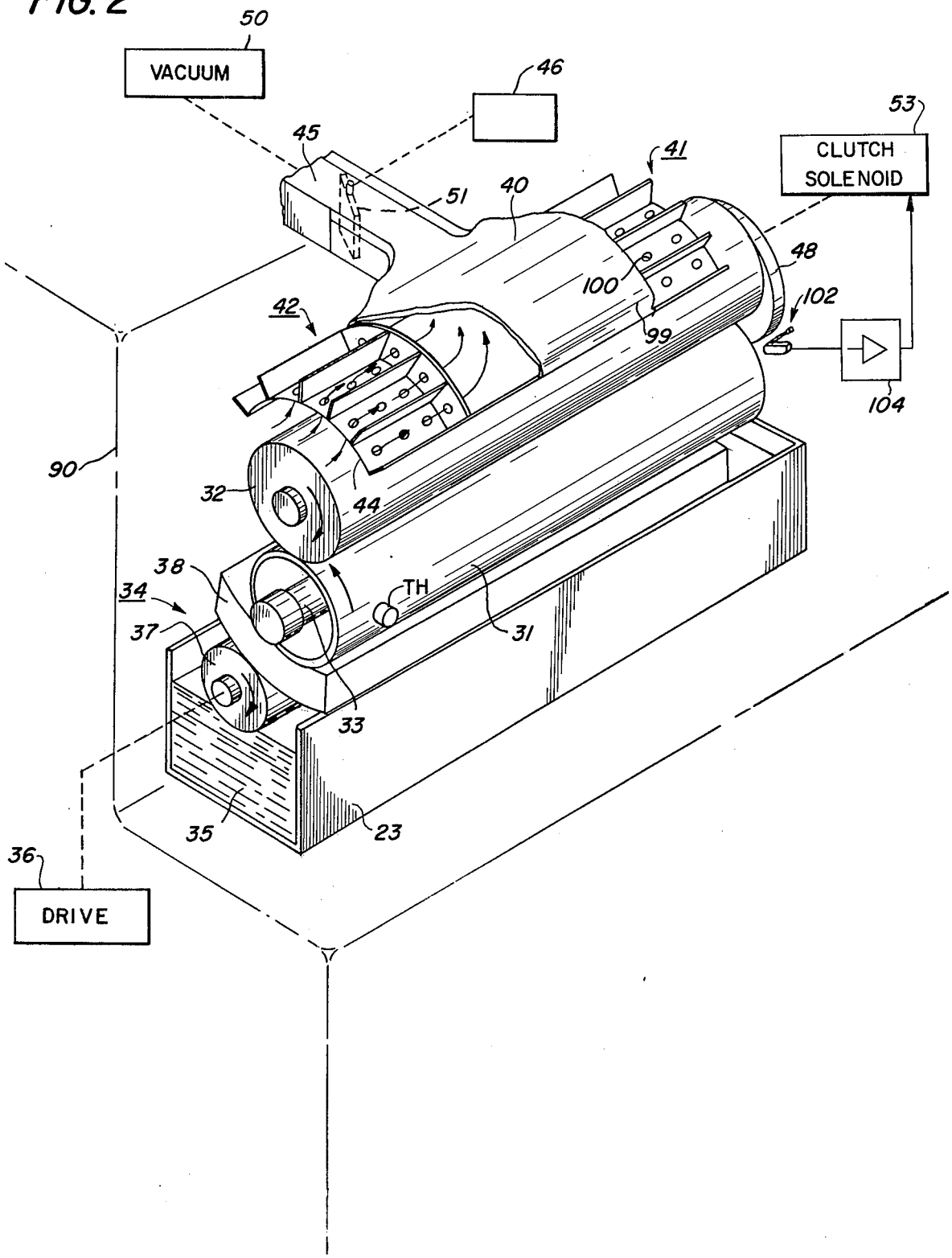
FIG. 2 shows a perspective view of the fusing apparatus according to the present invention.

As is well known in the art, in fusing the image to the sheet, a suitable heating means is employed to heat the toner particles so that they fuse onto the fabric of the copy sheet for permanent retention. FIG. 2 illustrates applicant's inventive apparatus to effect the fusing operation. A pressure roller 32 is disposed above the fuser roll 31. The outer peripheral portion of the pressure roll 32 may be made of a relatively soft rubber-like material which deforms under pressure to permit, when pressed, an arcuous contact area with the fuser roller, the periphery of which may be made of relatively hard substance. As shown, the fuser roller may comprise a relatively hard hollow cylindrical member which is also heat conductive and a heating means such as a lamp 33, disposed axially within the cylindrical member.

The fuser apparatus also includes a lubrication oil dispensing means 34 which includes an oil reservoir 35, a rotating applicator roll 37 partly immersed in the oil as shown, and a wick member 38 of a suitable design and composition. The wick cooperates with the applicator roll 37 to absorb lubrication oil placed thereon and transmit the oil to the fuser roller 31. A thin film of the oil is maintained within the nip formed between the two rollers 31 and 32 for providing the lubrication necessary in the fusing operation, as is well known in fuser technology. The oil is dispersed directly to the wick by means of the rotating oil applicator roll 37 cooperating with the lower surface of the wick 38.

Positioned atop the pressure roller 32 is a cover 40 of a suitable design that includes edge portions 41 and 42. The edge portions have segmented cooling shoes 44 and internal channels that are connected via a conduit 45 to a vacuum source indicated generally as 50. An air valve 51 is positioned within the conduit. Suitable means such as a solenoid member 46 is provided to actuate a closing or an opening of the conduit 45 over the end portions of the pressure roller for removal of heat therefrom when the copy sheet width or the image width is sufficiently narrow so that the end portions do not require fusing operation.

Accordingly, principle functions of the use of the edge cooling shoes is for fusing differently sized copy sheets and for minimizing unnecessary heating of end portions of the pressure roller when not needed. Thus, for a wide copy sheet that extends the length of the fuser roller 31, the air valve 51 is left closed so that the air flow is turned off. This prevents the edge cooling. When a narrow copy sheet is used that does not extend over the edge portions 41 and 42, then the air valve 51 is opened to allow the vacuum 50 to pull air through the edge cooling shoes 44. This provides a narrower heating range over the length of the pressure roller 32 for the narrower paper.

When the fuser is not in operation, the pressure roller 32 is disengaged from the fuser roller by any suitable means, such as a solenoid driven clutch mechanism 53, so that the former does not press against the later. Activation of the clutch mechanism disables a suitable drive means 48 that drives the pressure roller 32 and the fuser roller 31 and also moves the pressure roller 32 out of engagement with the fuser roller 31, thereby turning off the fusing apparatus.

In accordance with another aspect of the present invention, control means are provided to operate selectively and/or in timed sequence with the various aforementioned operative elements such as the oil dispensing means, the fuser roller, the pressure roller and the cooling means. The control means are also designed to operate the operative elements of the fusing apparatus only when their operations are required to provide the fusing operation. This minimizes wear and tear of the fusing apparatus and elminates fire hazards. Thus, referring to the figures, and more particularly, FIG. 3, the apparatus according to the present invention includes control means 80 for controlling the operation of the heating lamp 33 and means for providing suitable timed control signals for actuating and de-actuating the oil applicator drive means 36, the clutch solenoid 53 for the roller drive means 48, and the solenoid 46 for the air valve 51.

Figure 3:
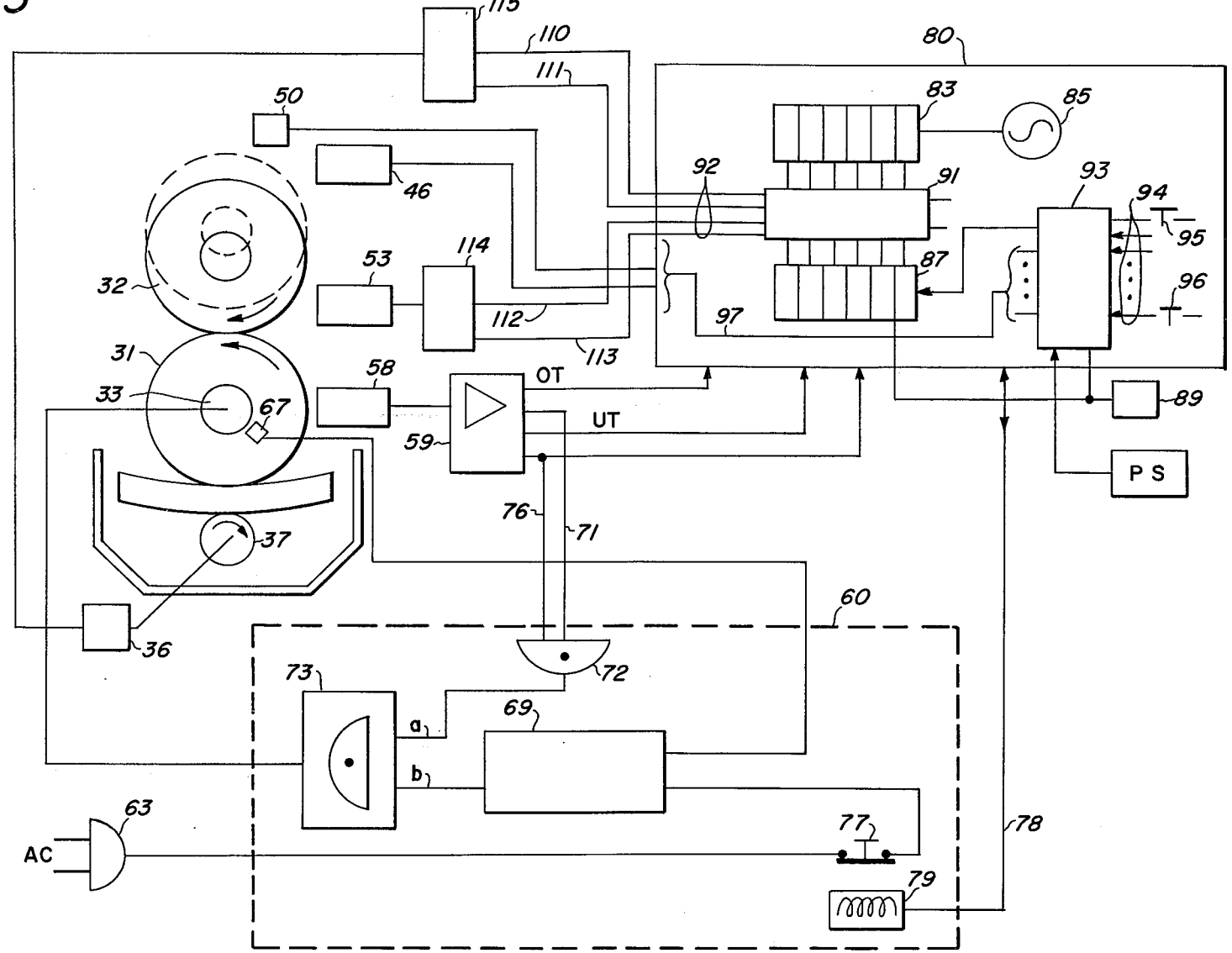
FIG. 3 shows a schematic block diagram of control means that may be used to operate the fusing apparatus.

More specifically, referring to FIG. 3, means for controlling the operation of the heating lamp 33 includes means such as a thermistor 58 for sensing the temperature of the fuser roller 31. The temperature level indicating signal generated by the thermistor is applied to a suitable amplifying means 59. The amplifying means, in turn, is adapted to generate several different signals that signify an over-temperature condition OT, under-temperature condition UT, and a normal temperature condition N within an acceptable range, and a condition signal on path 76 signifying proper operation or malfunction of the temperature sensing means 58. For a detailed description of such amplifying means, one may refer to the U.S. Pat. No. 3,735,092 to Robert Traistor assigned to the assignee of the present application and which is expressly incorporated by reference to this application.

The fuser lamp control means also includes a suitable means 73 to control the power applied to heating lamp 33 to a certain predetermined level and turn off the power supply when certain conditions are detected. Such a means is of a design that acts as an AC switch which turns the AC power line on to maintain the temperature of the fuser roller within a given range and turn off the power entirely when either the machine encounters malfunction or jam conditions of the fusing apparatus, particularly when the thermistor fails to function. More specifically, to perform these functions, the control means 60 may comprise two feedback control loops. One loop may include means 67 that senses the voltage or power applied to the lamp 33 and generates an output signal, and a current limiting means 69 which is designed to respond to the output of the means 67 and switch or gate the AC input line power therethrough to the lamp 33.

The current limiting means 69 may be a design that provides an AC switching function wherein the voltage output of the voltage sensing means 67 is used to open and close the switch. The circuit 69 is preferably designed so that it opens and closes intermittently to maintain the power applied to the heating lamp 33 within a given range. Preferably, the means 69 is adapted to apply substantially full power supplied by the power line when the power line supply voltage falls near the minimum, the so called "brown out" line power or voltage level, to heat the heating lamp 33 to the necessary temperature level, but remove or switch off the line power intermittently when the line power or voltage exceeds the minimum level in maintaining the temperature of the heating lamp 33 within the acceptable range. For a suitable circuit of the aforementioned type that includes AC switching means 69, one may refer to the U.S. Pat. application Ser. No. 312,557 filed on Dec. 6, 1972, which was abandoned but which continues in the continuation application Ser. No. 382,638, filed on July 29, 1973, both applications being assigned to the assignee of the present application and expressly incorporated to the present application by reference.

The second feedback loop for the heater lamp control includes the temperature sensing means 58, the amplifying arrangement 59 that provides signals indicative of failure of the thermistor to function via path 76, the normal temperature level condition N of the fuser roller 31 via path 71, a coincidence gating means 72, and an AC gating means 73 of suitable designs, all operatively connected to gate the output of the AC switching means 69 therethrough to the heating lamp 33 when a set of required conditions are met and turn off or prevent the flow of the AC line current therethrough when the conditions are not met.

The gate 73 itself may be of any suitable conventional design that closes or opens in response to the presence or absence of the two coincident inputs; one input being from the current limiting means 69 and the other from the gating means 72. A conventional photo-optical coupling arrangement with photo-conducting AC triac circuit would be suitable for such a gating means 73. The gating means 72 may be in the form of an AND gate 72 to sense satisfaction of certain conditions and generate an output of logical 1 and apply it to the input of the gate 73. The certain conditions mentioned above are preferably designed to reflect the operative conditions of the fuser apparatus. For example, if the thermistor 58 does not operate properly, this may be sensed by the amplifying means 59. The latter, in turn, sends a logical 0 and applies it to the gate 75 via the path 76. This, in turn, causes the gate 72 to apply logical 0 to the input of the gate 73. In turn, the gate 73 is disabled, and this prevents the AC power output from the current limiting means 69 from passing there through to the heating lamp 33. Consequently, the fuser apparatus is prevented from operation, if the thermistor does not operate properly. Similarly, if the amplifying arrangement 59 provides a signal indicating that the thermistor fails to operate properly, a signal of logical 0 is applied to the AND gate 72 to disable the gate 73 and turn off the AC power supply.

This feedback loop via the gate 72 prevents fire hazards of the fusing apparatus that would go undetected if the lamp 33 goes on and overheats and yet the thermistor fails to detect this due to its malfunction.

As shown, the normal temperature range signal of logical 1 from the amplifier 59, indicative of the fact that the temperature of the fuser is in the normal condition, is also applied to AND gate 72. If the temperature is in the normal range, then that signal plus the signal of logical 1 from the output 76 indicating, proper operation of the thermistor, causes the gate 72 to apply logical 1 to the switch 73. This inhibits the flow of the power from the limiter 69. This continues until temperature of the fuser goes below the normal and then the inhibiting signal is removed to heat the lamp 33 again.

In summary then, the first feedback loop comprised of the voltage sensing means 67 and the current limiting means 69 is used to control the amount of the power applied to the lamp within a suitable acceptable level. The second feedback loop comprised of the heat sensing means 58 and the amplifying means 59, permits the power output of the current limiter 69 to flow to the heating lamp 33 normally but prevents its flow entirely when malfunction of the heat sensing means is detected.

The aforementioned control means for the fuser heating lamp 33 may be further enhanced by introducing still another control loop. Thus, for example, there may be provided a suitable switching means schematically represented by a switch 77 interposed between the power supply line 63 and the current limiter 69. This switch 77 is then placed under the control of the control means 80. When the control signal is applied via a path 78 to a suitable means 79 such as a relay, means 79 opens the line current path and cuts off the power to the limiter 69, and hence to the heating lamp 33. This additional control loop may be used advantageously to meet machine emergency conditions which have over-riding importance over the control provided by the first and second feedback loops in supplying the power to the heating lamp 33. With such additional over-ride, the feedback control loop may be advantageously used to meet certain machine emergencies such as jams or the copy sheet adhering to the photoconductor after the image transfer operation that requires an immediate stop of the machine.

Another aspect of the present invention entails timed operation of the operative elements; such as the applicator roller 29, the clutch solenoid 53, the vacuum valve solenoid 51, under the control of the central means 80. The control means 80 may comprise a synchronous and asynchronous logic sections wherein the synchronous section is designed to provide more precisely timed control signals and wherein the asynchronous section is designed to provide less rigidly timed signals which are not synchronous with imaging cycles of the machine operation. For example, the synchronous section may comprise a high speed counter 83 for counting clock pulses from a clock source 85, a shift register 87 responsive to a train of pitch pulse signals from a source 89 which provides the pulses in succession keyed to the successive imaging cycles, and a logic matrix 91 responsive to the output of the shift register 89 and the counter 83 for generating the precisely timed signals are applied via suitable paths 92 to their corresponding output utilization stations in the machine that require precise timing. The asynchronous logic section 93 of the control means 80 is designed to respond to a set of input signals via suitable paths 94, such as print start actuation button 95 and other indications that signify that the machine is ready to operate. The asynchronous logic provides suitable output signals via its output paths 97 to their utilization means or processing stations.

For the more detailed description of the aforementioned type of control means 80, one may refer to the U.S. Pat. application Ser. No. 97,745 filed on Dec. 14, 1970 which was continued in Ser. No. 244,734 filed on Apr. 12, 1972 and which now continues in the application Ser. No. 438,972 filed on Feb. 4, 1974, all applications assigned to the assignee of the present application. The aforementioned applications are hereby expressly incorporated by reference into the present application.

Referring to FIG. 3 the timed output signals of the asynchronous logic 93 of the control means 80 are utilized to actuate the vacuum pump means 50, the clutch solenoid means 53 and the drive means 36 driving the applicator roller 37 in any suitable time sequence as the operational requirement or machine requirement dictates. For example, in operation, it may be desirable to turn the fuser lamp 33 on as soon as the machine is turned on, i.e. power on button 96 is pressed. But the control means does not permit the machine to run certain component elements, such as, the photoconductor belt until the fusing temperature is reached at the fusing station.

Thus, when the under temperature signal UT exists and is applied to tha asynchronous logic 91, the control means does not generate control signals to actuate the applicator roller 34 or clutch solenoid 53 or the vacuum means 50 on main machine drive motor that drives the photoconductor belt.

In response to UT and OT, i.e. normal condition signal, control means 80 provides control signals for actuating solenoid means 53. Other inputs such as the absence of jam condition or presence of paper supply, etc. are used as the necessary inputs to the control means before the means will generate output signals through output path 97 to the utilization means. Among such input signals one is a logical signal applied to the control means 80 that indicates the copy sheet size. Suppose the paper sheet supplied at the paper tray PS is of a narrower length, e.g. letter size length that corresponds in width to the fuser roller without the end cooling sections. Suitable sensing means PS is used to sense this and provide a logical signal to the asynchronous logic 93. In turn, the logic 93 provides a control signal to actuate the vacuum valve drive solenoid 46. The actuated solenoid then opens the valve 51 to apply air to cool the end sections of the pressure roller 32.

When the fuser roller 31 reaches an acceptable level of fusing temperature, the temperature sensing means 58 enables the amplifying means 59 of the fuser temperature control means to provide output signals UT, OT and normal N to the control means 80. When actuated, the oil applicator drive means 36 rotates the applicator roller 37. The roller 37 in turn applies the oil to the wick 38 to lubricate the nip formed between the fuser roller 31 and the pressure roller 32, as described before. When actuated, the clutch solenoid 53 cams or moves the pressure roller 32 into a pressing relationship to the fuser roller 31. There is provided a suitable switching means 102 disposed to sense a predetermined travel distance of the pressure roller 32 to the fuser roller 31.

When the travel is finished, which in effect means that when the pressure reaches a predetermined level, switch 102 provides an output signal to a suitable circuit means 104 which may comprise an amplifier. The amplifier in turn applies its output to the clutch means 53 to deenergize or de-clutch the clutch solenoid so that the pressure roller 32 is prevented from camming or pressing into the fuser roller 31 any further.

The acting elements of the fusing apparatus may be operated in the following sequence: First, when the operator starts the machine by turning on the machine power suply switch, the control means 80 generates an actuating signal for the machine vacuum means and senses paper size. If the paper size sensing means senses the smaller size sheet, the control provides a control signal to actuate the solenoid 46 to open the valve 51 after the print button is pressed and the machine starts to print.

In the meantime, when the power supply is switched on, the power is immediately applied to fuser lamp to cause it to heat up. When the fuser reaches an acceptable temperature range, it so signifies the control means 80 via the path from the thermistor 58 amplifying means and signal path N. The control means 80 in turn causes the machine to be ready for print operation, i.e. imaging process and feed the copy sheets. At this point, the control means 80 may be so designed that its timing means, that is the shift registers and the counters, are utilized by the logic matrix 91 to generate output signals which are in turn applied to actuate certain of the existing members of the fuser apparatus in a timed manner. The control provides signals to the pressure roller camming solenoid 53 and the lubrication applicator drive 36 for a period of time to allow the lubrication to take place at the nip and the pressure roller 32 is brought into the camming relationship with the predetermined distance or pressure level just before the first imaged copy sheet arrives at the fusing station.

The control means 80 is designed to provide control signals to de-actuate clutch solenoid and the applicator roller drive means 36 when the machine completes a copy run or when the machine goes into interrupt mode due to some malfunction. Such de-actuating signals may be generated at a given pitch or time period after the machine interrupt cycle begins or the copy run is complete to allow the last sheet in the paper path to pass out the fusing station. Timed control signals from the logic matrix 91 of the synchronous logic section may be provided via paths 110 and 111 and 112 and 113 to suitably latch circuits 114 and 115 interposed between the clutch solenoid 53 and tha applicator drive means 46 respectively. More specifically, in timing the control signals, the decode matrix 91 may be designed to generate the control signals to actuate the clutch solenod 53 and the applicator drive 36 via the latches 114 and 115 three or four pitches or imaging cycles before the arrival of the first sheet and turn off a given period of time after the interrupt or the copy run complete signal is received by the control means 80.

However, when the machine has to be stopped immediately, the pressure roller 32 has to be declutched immediately, as is the case when certain types of jam conditions occur. The logic matrix 91 may be designed to provide reset signal immediately to the latch 115 and thus declutch the roller 32 immediately.

While the invention has been described in particular with reference to a specific illustrative embodiment thereof, it will be obvious to the persons of ordinary skill in the art that various changes and modifications may be made without departing from the spirit and scope of the invention. It is therefore intended that the appended claims be interpreted as including such changes and modifications.

What is claimed is:

1. In an electrostatic reproducing machine wherein latent electrostatic images are formed and developed with toner particles deposited on photo-conductor means, said developed images transferred to copy sheets, an improved fusing apparatus for fusing said toner particles to said copy sheets comprising:

a fuser roller;

means for heating said fuser roller;

a pressure roller;

means for driving said pressure roller into a first position in response to a first control signal wherein said pressure roller is urged against said fuser roller at a predetermined pressure level, said drive means moving said pressure roller into a second position in response to a second control signal wherein said pressure roller is removed from said fuser roller; and means for controlling said drive means, said control means applying said first control signal to said drive means when machine condition signals indicate a start of a copying operation, said control means applying said second control signal to said drive means in response to signals indicating completion of said copy operation, said control means applying said second control signal to said drive means in response to machine condition signals indicating a copy operation malfunction.

2. The improved fusing apparatus of claim 1 wherein said heating means includes a heating element, wherein said control means includes apparatus for controlling power applied to said heating element, said power control apparatus of said control means including a first central loop for limiting said power to said heating element to a predetermined level, said power control apparatus including a second central loop for disabling said first central loop in response to predetermined machine condition signals.

3. The improved fusing apparatus of claim 2 wherein said control means includes apparatus for operating said fusing apparatus in a timed, sequential order.

4. The improved fusing apparatus of claim 1 further including controllable apparatus for cooling a preselected portion of said fuser roller, said cooling apparatus actuated by said control means in response to preselected reproducing machine condition signals.

* * * * *